US009805898B2

(12) United States Patent
Randall et al.

(10) Patent No.: US 9,805,898 B2
(45) Date of Patent: Oct. 31, 2017

(54) FUSE ARC GAS BAFFLE WITH ARC RESISTANT FUSE ASSEMBLY

(71) Applicant: Eaton Corporation, Cleveland, OH (US)

(72) Inventors: Alfred Lee Randall, Landrum, SC (US); Thomas Arthur Farr, Candler, NC (US); John Austin Cochran, Pisgah Forest, NC (US); Irving Albert Gibbs, Mills River, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 15/181,763

(22) Filed: Jun. 14, 2016

(65) Prior Publication Data

US 2017/0032920 A1 Feb. 2, 2017

Related U.S. Application Data

(60) Provisional application No. 62/199,347, filed on Jul. 31, 2015.

(51) Int. Cl.
*H01H 85/38* (2006.01)
*H01H 85/43* (2006.01)

(52) U.S. Cl.
CPC ..... *H01H 85/38* (2013.01); *H01H 85/43* (2013.01)

(58) Field of Classification Search
CPC ..... H01H 85/38; H01H 85/43
USPC ..... 337/273
See application file for complete search history.

(56) References Cited

U.S. PATENT DOCUMENTS 4,019,005 A * 4/1977 Michetti ..... H01H 9/342 200/306
4,876,424 A * 10/1989 Leone ..... H01H 9/342 200/306
4,965,544 A * 10/1990 Kelaita, Jr. ..... H01H 9/0264 174/138 F
5,241,289 A * 8/1993 Markowski ..... H01H 9/342 335/201
5,317,117 A * 5/1994 Bruski ..... H01H 9/342 218/153
5,574,624 A * 11/1996 Rennie ..... H02B 13/025 200/289
5,710,402 A * 1/1998 Karnbach ..... H02B 13/025 218/157
6,367,203 B1 * 4/2002 Graham ..... B65D 90/36 137/70

(Continued)

*Primary Examiner* — Anatoly Vortman
(74) *Attorney, Agent, or Firm* — Eckert Seamans; David Jenkins; Philip Levy

(57) ABSTRACT

A protection system for an electrical apparatus is disclosed. The protection system includes a baffle assembly and a coating for electrical elements exposed to arc gasses. The baffle assembly includes a number of generally planar sidewalls, each sidewall including a first edge surface, a second edge surface, and a third edge surface. The sidewalls are disposed in a spaced, generally parallel configuration defining a number of channels. A first end wall, is sealingly coupled to each sidewall first edge. A second end wall is sealingly coupled to each sidewall second edge. A third end wall is sealingly coupled to each sidewall third edge. The terminals of an electrical apparatus are disposed in an aligned set with one set of terminals in each channel. The channels are structured to limit the flow of arc gasses across adjacent sets of terminals.

20 Claims, 3 Drawing Sheets

(56) References Cited

U.S. PATENT DOCUMENTS

| | | | | |
|---|---|---|---|---|
| 6,388,867 | B1 * | 5/2002 | Rakus | H01H 9/345 200/306 |
| 6,407,331 | B1 * | 6/2002 | Smith | H02B 13/025 174/17 VA |
| 6,407,354 | B1 * | 6/2002 | Turner | H01H 9/342 218/155 |
| 6,417,443 | B1 * | 7/2002 | Smith | H02B 1/565 174/17 VA |
| 6,512,192 | B1 * | 1/2003 | Yee | H01H 9/342 218/157 |
| 6,762,389 | B1 * | 7/2004 | Crooks | H01H 9/342 218/157 |
| 6,924,721 | B2 * | 8/2005 | Afshari | H01H 9/342 218/157 |
| 7,054,143 | B2 * | 5/2006 | Eiselt | H02B 13/025 218/155 |
| 7,778,013 | B2 * | 8/2010 | Bruski | H02B 1/56 361/605 |
| 7,864,022 | B2 * | 1/2011 | Borchardt | H01H 85/43 218/157 |
| 7,974,078 | B2 * | 7/2011 | Coomer | H02B 13/025 312/236 |
| 8,325,478 | B2 * | 12/2012 | Siracki | H05K 7/20145 361/678 |
| 9,608,415 | B2 * | 3/2017 | Cardin | H02B 13/025 |
| 9,627,866 | B2 * | 4/2017 | Pawar | H02B 1/56 |
| 2012/0120558 | A1 * | 5/2012 | Raabe | H01H 71/025 361/619 |
| 2016/0156163 | A1 * | 6/2016 | Faber | H02B 13/025 361/605 |

* cited by examiner

FUSE ARC GAS BAFFLE WITH ARC RESISTANT FUSE ASSEMBLY

CROSS-REFERENCE TO RELATED APPLICATION

This application claims the benefit of U.S. Provisional Patent Application No. 62/199,347, which was filed on Jul. 31, 2015, and is entitled "FUSE ARC GAS BAFFLE WITH ARC RESISTANT FUSE ASSEMBLY."

BACKGROUND OF THE INVENTION

Field of the Invention

The disclosed and claimed invention relates to an electrical apparatus and, more specifically, to a baffle assembly disposed adjacent a number of terminals and structured to limit the cross-flow of an arc gas to laterally adjacent terminals.

Background Information

Electrical apparatuses are tested for various fault conditions. Many electrical apparatuses include terminals coupled to a conductor assembly, a line, load, or other conductor. One manner of testing fault conditions at the terminals includes placing a conductor, such as but not limited to a wire, across terminals that are not, during normal operation of the electrical apparatus, in electrical communication. For example, the wire may be disposed across terminals of different phases in a three-phase electrical apparatus. The wire may generate an arc which, in turn, generates arc gasses. The arc gasses may damage components of the electrical apparatus.

There is, therefore, a need for a protection system that limits the flow of arc gasses over the terminals of an electrical apparatus. There is a further need for a protection system that protects elements exposed to arc gasses.

SUMMARY OF THE INVENTION

These needs, and others, are met by at least one embodiment of the disclosed and claimed protection system which includes a baffle assembly and a coating for electrical elements exposed to arc gasses. In an exemplary embodiment, the baffle assembly includes a number of generally planar sidewalls, each the sidewalls including a first edge surface, a second edge surface, and a third edge surface. The sidewalls are disposed in a spaced, generally parallel configuration defining a number of channels. The sidewall first edges and the sidewall second edges extending in generally different directions. A first end wall, is sealingly coupled to each sidewall first edge. A second end wall is sealingly coupled to each sidewall second edge. A third end wall is sealingly coupled to each sidewall third edge. The terminals of an electrical apparatus are disposed in an aligned set with one set of terminals in each channel. The channels are structured to limit the flow of arc gasses across adjacent sets of terminals.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
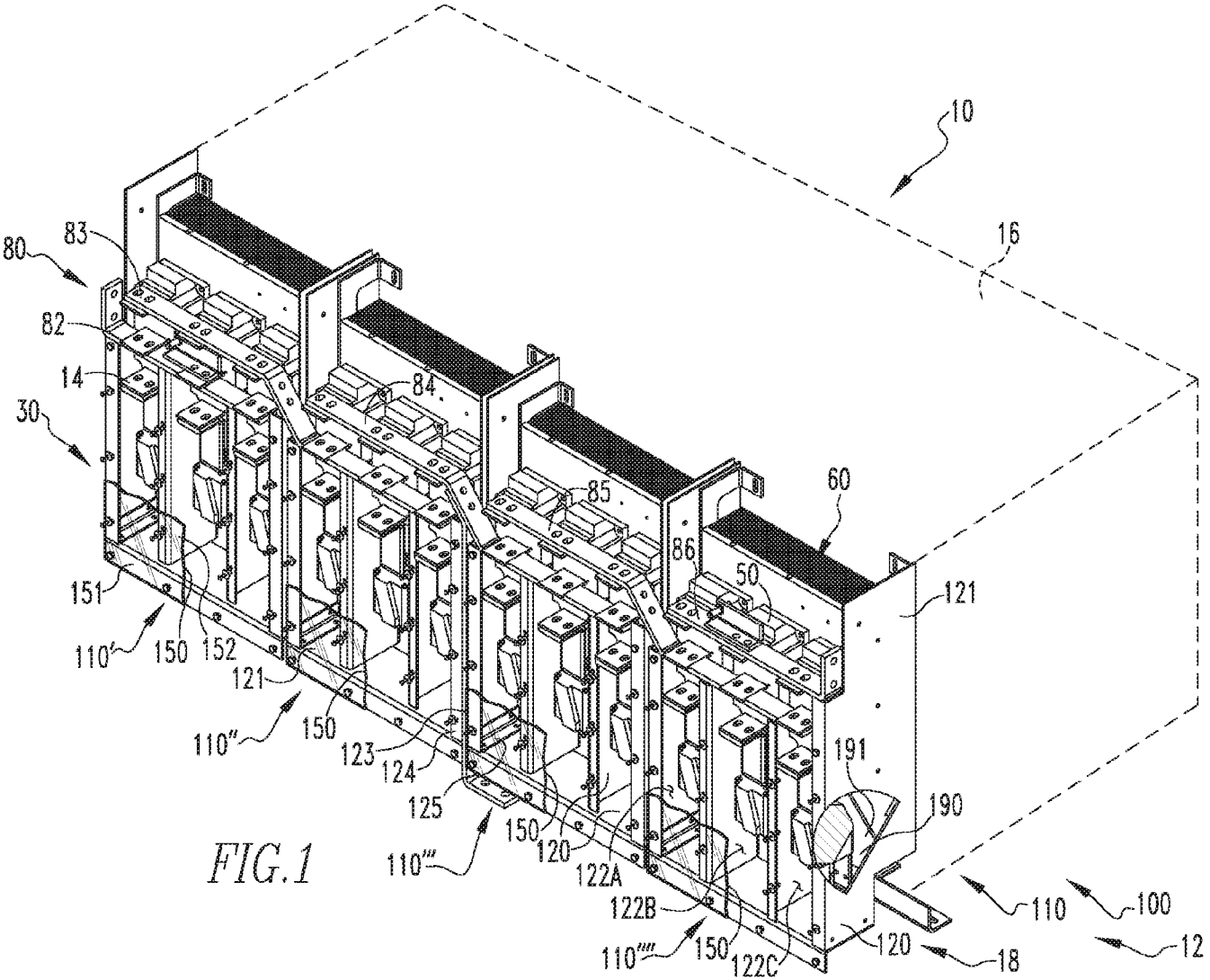
FIG. 1 is an isometric view of an electrical apparatus.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the word "unitary" means a component is created as a single piece or unit. That is, a component that includes pieces that are created separately and then coupled together as a unit is not a "unitary" component or body.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut. It is further understood that an opening or passage through which another coupling component extends is also a coupling component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, a first object resting on a second object, which is held in place only by gravity, is not "coupled" to the second object unless the first object is otherwise linked to the second object. That is, for example, a book on a table is not coupled thereto, but a book glued to a table is coupled thereto.

As used herein, the statement that two or more parts or components "engage" one another shall mean that the elements exert a force or bias against one another either directly or through one or more intermediate elements or components.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw; however, when a rotational force is applied to the screwdriver, the screwdriver "operatively engages" the screw and causes the screw to rotate.

As used herein, the term "number" shall mean one or an integer greater than one (i.e., a plurality).

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit. Further, as used herein, "loosely correspond" means that a slot or opening is sized to be larger than an element disposed therein. This means that the increased size of the slot or opening is intentional and is more than a manufacturing tolerance. Further, with regard to a surface formed by two or more elements, a "corresponding" shape means that surface features, e.g. curvature, are similar.

As used herein, "structured to [verb] or "be an [X]" means that the identified element or assembly has a structure that is shaped, sized, disposed, coupled and/or configured to perform the identified verb or to be what is identified in the infinitive phrase. For example, a member that is "structured to move" is movably coupled to another element and includes elements that cause the member to move or the member is otherwise configured to move in response to other elements or assemblies. As such, as used herein, "structured to [verb or "be an [X]"]" recites structure and not function. Further, as used herein, "structured to [verb or "be an [X]"]" means that the identified element or assembly is intended to, and is designed to, perform the identified verb or to be an [X]. Thus, an element that is only possibly "capable" of performing the identified verb but which is not intended to, and is not designed to, perform the identified verb is not "structured to [verb or "be an [X]"]."

As used herein, a "path" or "path of travel" is the space an element moves through when in motion.

As used herein, "temporarily coupled" means that two components are coupled in a manner that allows for the components to be easily decoupled without damaging the components. For example, elements that are coupled by a nut/bolt coupling are "temporarily coupled," while elements that are welded together are not. The channels disposed about a molded case circuit breaker terminal, which are part of the molded case housing assembly, are not "temporarily coupled," as used herein, to the molded case circuit breaker housing assembly; such channels are formed by the molded case circuit breaker housing assembly and are unitary therewith. That is, even if the molded case circuit breaker housing assembly is separable, i.e. an upper portion and a lower portion, the portions of the channel are still unitary with the associated portion of the molded case circuit breaker housing assembly. Thus, the channels are not "temporarily coupled," as used herein, to the molded case circuit breaker housing assembly.

Figure 2:
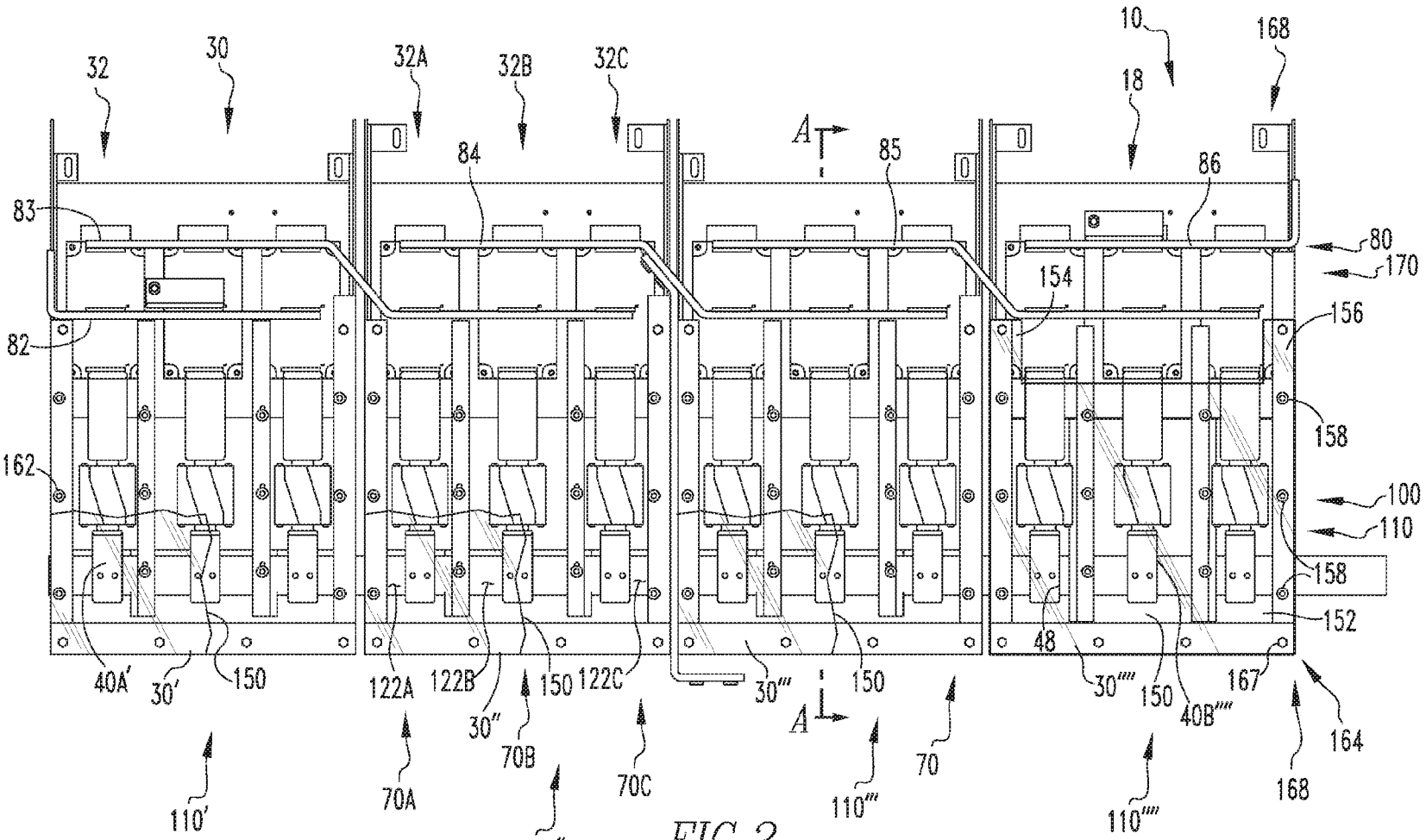
FIG. 2 is a back view of an electrical apparatus.
Figure 3:
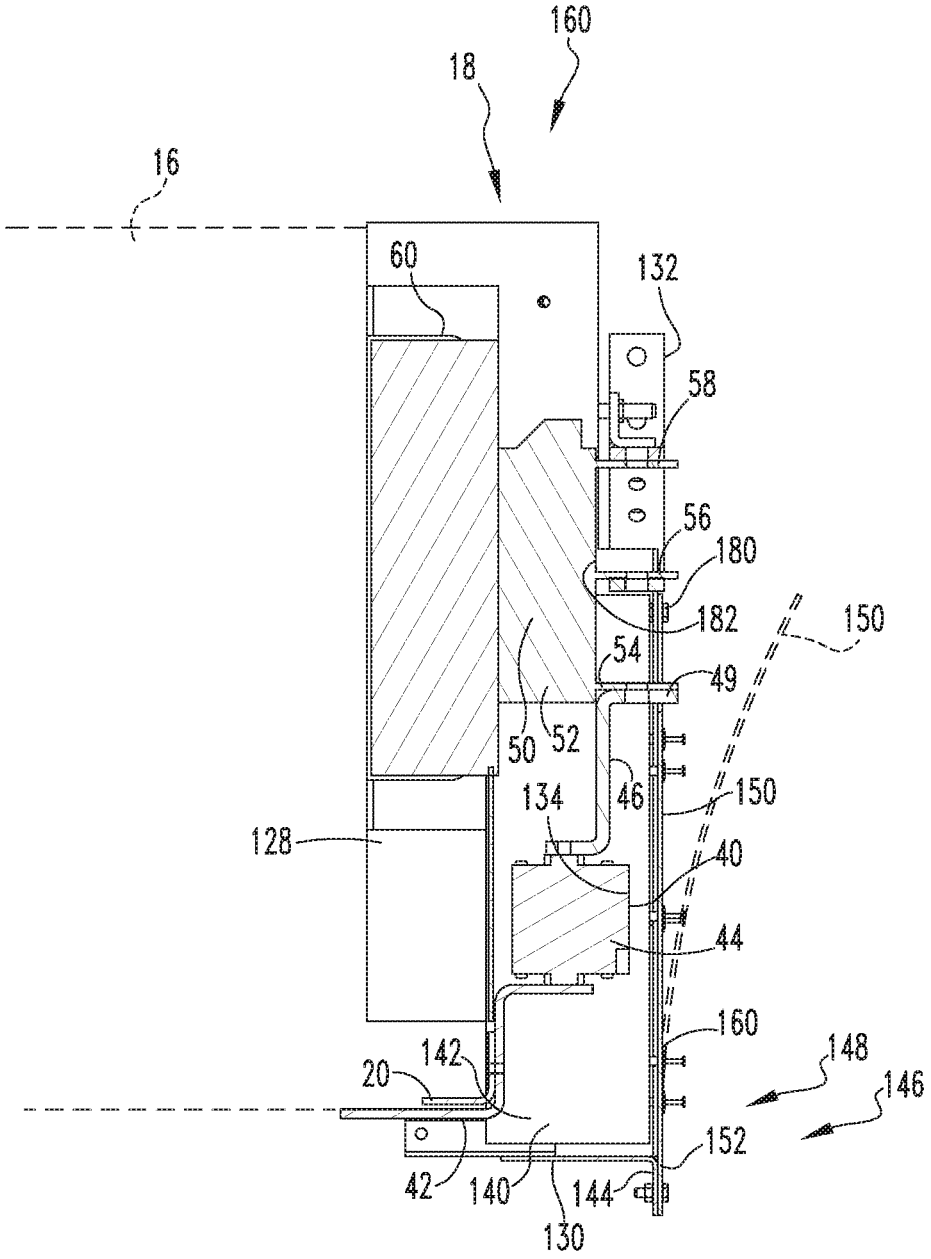
FIG. 3 is a cross-sectional side view of an electrical apparatus.

As shown in FIGS. 1-3, an electrical apparatus 10 includes a number of electrical components 12 wherein the electrical components 12 include a number of terminals 14. As an exemplary embodiment, the electrical apparatus 10 is shown as a transformer 16 (shown schematically) with a rectifier 18. It is understood that this specific electrical apparatus is an example only and the protection system 100, discussed below may be used in association with any electrical apparatus 10 with terminals 14 in the configuration (s) discussed below. The electrical apparatus 10 also includes a conductor assembly 80, and a protection system 100.

The transformer 16 includes three phases (not shown) wherein each phase includes a transformer coupling 20 that is structured to be coupled to, and in electrical communication with, the rectifier 18. The transformer coupling 20 may include a secondary cable. The rectifier 18, as shown, includes four substantially similar units 30. As each rectifier unit 30 is similar, only one will be described. Thereafter, elements of a first rectifier unit 30' shall be identified by a prime mark, i.e. "′", elements of a second rectifier unit 30" shall be identified by a double-prime mark, i.e. "″", elements of a third rectifier unit 30''' shall be identified by a triple-prime mark, i.e. "‴", elements of a fourth rectifier unit 30'''' shall be identified by a quadruple-prime mark, i.e. "⁗".

Further, a rectifier unit 30 includes three substantially similar sets of components for each phase, hereinafter a "pole assembly" 32A, 32B, 32C. Each pole assembly 32A, 32B, 32C includes substantially similar sub-components; namely a fuse assembly 40, a diode 50, and a heat sink 60. As these elements are similar, only one pole assembly 32 will be described, thereafter, elements associated with the first phase will be identified by the letter "A," elements associated with the second phase will be identified by the letter "B," and elements associated with the third phase will be identified by the letter "C." Thus, for example, the fuse 40 for the first phase of the first rectifier unit 30' shall be identified as fuse 40A' while the fuse 40 for the second phase of the fourth rectifier unit 30∴" shall be identified as fuse 40B''''.

In an exemplary embodiment, each pole assembly fuse assembly 40 includes a first conductor 42, a fuse element 44, a second conductor 46, and a coating 48, discussed below. It is understood that each pole assembly fuse assembly conductor 42, 46 is a conductive member and is, in an exemplary embodiment, a generally planar, elongated member that may be selectively bent to a desired shape. The pole assembly fuse assembly first conductor 42 is structured to be, and is, coupled to, and in electrical communication with, a transformer coupling 20. The pole assembly fuse assembly first conductor 42 is also structured to be, and is, coupled to, and in electrical communication with, pole assembly fuse assembly fuse element 44. The pole assembly fuse assembly fuse element 44 is structure to break the electric circuit upon a selected over-current event, as is known in the art. The pole assembly fuse assembly second conductor 46 is structured to be, and is, coupled to, and in electrical communication with, pole assembly fuse assembly fuse element 44. The pole assembly fuse assembly second conductor 46 is further structured to be, and is, coupled to, and in electrical communication with, a diode first terminal 54, described below. It is noted that a pole assembly fuse assembly second conductor distal end extends outwardly and generally normal to the page as shown in FIG. 2; in this configuration, the pole assembly fuse assembly second conductor distal end is a fuse terminal 49.

Each diode 50 includes a diode element 52, a first terminal 54, a second terminal 56 and a third terminal 58. It is understood that each diode terminal 54, 56, 58 is a conductive member and is, in an exemplary embodiment, a generally planar, elongated member. Diode element 52 is a diode as is known in the art. The diode first terminal 54 is structured to be, and is, coupled to, and in electrical communication with fuse terminal 49. The diode first terminal 54 is further structured to be, and is, coupled to, and in electrical communication with diode element 52. The diode second terminal 56 is structured to be, and is, coupled to, and in electrical communication with a conductor assembly bus member 82, 83, 84, 85, 86. The diode second terminal 56 is further structured to be, and is, coupled to, and in electrical communication with diode element 52. The diode third terminal 58 is structured to be, and is, coupled to, and in electrical communication with a conductor assembly bus member 82, 83, 84, 85, 86. The diode third terminal 58 is further structured to be, and is, coupled to, and in electrical communication with diode element 52. It is noted that each diode terminal 54, 56, 58 extends outwardly and generally normal to the page as shown in FIG. 2. As used herein, the longitudinal axis of a diode terminal 54, 56, 58 extends outwardly and generally normal to the page as shown in FIG. 2; i.e. generally horizontally and outwardly from the electrical apparatus 10. Further, each diode element 52 is coupled, directly coupled, or fixed to a heat sink 60.

As shown in FIG. 2, the fuse terminal 49 and the diode terminals 54, 56, 58 are disposed along a common vertical axis. That is, a vertical axis passes generally through each of the fuse terminal 49 and the diode terminals 54, 56, 58. As is known, the vertically aligned fuse terminal 49 and the diode terminals 54, 56, 58 are all associated with one phase of the electrical apparatus 10. Further, as used herein, an aligned associated group of terminal 49, 54, 56, 58 are identified collectively as an "aligned set" of terminals 70. Accordingly, each rectifier unit 30 includes a plurality (three as shown) of aligned sets of terminals 70A, 70B, 70C.

The conductor assembly 80 includes a number of elongated, conductive bus members 82, 83, 84, 85, 86 (as shown in an exemplary embodiment). The bus members 82, 83, 84, 85, 86 are structured to be coupled to, and in electrical communication with, a plurality of diode terminals 54, 56, 58. That is, each bus member 82, 83, 84, 85, 86 extends laterally across the diode terminals 54, 56, 58 within a rectifier unit 30, or, laterally across the diode terminals 54, 56, 58 of multiple rectifier units 30. In an exemplary embodiment, the specific configuration of the bus members 82, 83, 84, 85, 86 for a rectifier 18 is shown in FIG. 2.

The protection system 100, in an exemplary embodiment, includes a baffle assembly 110 and the coating 48, discussed above. The baffle assembly 110 is disposed adjacent the aligned sets of terminals 70A, 70B, 70C and is structured to limit the cross-flow of an arc gas to laterally adjacent terminals 70A, 70B, 70C. In an exemplary embodiment, the baffle assembly 110 is temporarily coupled to the electrical components 12.

While the baffle assembly 110 may be structured to span all the rectifier units 30', 30", 30''', 30'''', in an exemplary embodiment, the baffle assembly 110 is structured to span a single rectifier unit 30. Thus, in the embodiment shown, there are four cooperative baffle assemblies 110', 110", 110''', 110'''', wherein the reference number symbols are similar to the rectifier units 30', 30", 30''', 30'''' above. As the baffle assemblies 110', 110", 110''', 110'''' are similar, a single baffle assembly 110 is described below.

In an exemplary embodiment, the baffle assembly 110 includes a number of generally planar sidewalls 120, a first end wall 140, a second end wall 150, and a third end wall 190. As used herein, a "sidewall" is an element separating aligned sets of terminals 70A, 70B, 70C. That is, a "sidewall" may be disposed near the middle of the baffle assembly 110. In an exemplary embodiment, wherein there are three aligned sets of terminals 70A, 70B, 70C, there are four sidewalls 120. When the aligned sets of terminals 70A, 70B, 70C are vertically aligned, the sidewalls 120 also extend generally vertically. As used herein, to "extend" means that the longitudinal axis of the identified element is in the direction indicated. In an exemplary embodiment, the sidewalls 120 are generally planar elements. When the longitudinal axis of the diode terminals 54, 56, 58 extends horizontally and outwardly from the electrical apparatus 10, as described above, the plane of the sidewalls 120 is generally parallel to the longitudinal axis of the diode terminals 54, 56, 58.

In an exemplary embodiment, each sidewall 120 is generally rectangular body 121 that includes a first edge surface 130, a second edge surface 132, and a third edge surface 134. As used herein, a generally planar sidewall 120 "edge surface" is a surface other than the wide planar surfaces. An "edge surface" further includes a tab at the perimeter of a surface that extends generally normal to the plane of a generally planar sidewall 120. Further, as used herein, a "generally planar member" may include such a tab. In an embodiment with a generally rectangular sidewall 120, the first edge surface 130 is one of the generally straight shorter sides of the rectangular sidewall 120 (lower edge as shown). The second edge surface 132 and third edge surface 134 are the two generally straight, generally parallel longer sides of the rectangular sidewall 120. Thus, the second edge surface 132 and third edge surface 134 extend at an angle, and in an exemplary embodiment generally ninety degrees, to the first edge surface 130.

The sidewalls 120 are disposed in a spaced, generally parallel configuration defining a number of channels 122. That is, there is a sidewall 120 on either lateral side of each aligned sets of terminals 70A, 70B, 70C. As shown, the outer sidewalls 120 may have a greater longitudinal length than the inner sidewalls 120. Further, in an exemplary embodiment, the sidewalls 120 each include a number of tabs 124 disposed along at least one of the longer sides (second edge surface 132 as shown) of the rectangular sidewall 120. As used herein, a "tab" is a generally planar construct having a width smaller than an associated planar member. In an exemplary embodiment, the tab 124 projects generally normal to the plane of the generally planar sidewalls 120. Each tab 124 defines a number of sidewall longitudinal edge first coupling components 128 which, in an exemplary embodiment, are passages 129 sized to snuggly correspond to pressure release rivets 162, discussed below.

The first end wall 140, in an exemplary embodiment, is a generally planar body 142 that extends the lateral width of the baffle assembly 110. In the embodiment described above, the first end wall 140 is also generally rectangular. Further, in an exemplary embodiment, the outer longitudinal edge of the first end wall 140 includes a downwardly extending mounting tab 144. The mounting tab 144 projects in a plane generally normal to the plane of the first end wall 140. Further, the mounting tab 144 includes a number of mounting first components 146; as shown, passages 148. The second end wall 150, in an exemplary embodiment, is a cover 151. That is, the second end wall 150 is a generally planar, generally transparent body 152. In the embodiment shown, wherein the outer sidewalls 120 may have a greater longitudinal length than the inner sidewalls 120, the second end wall 150 is generally rectangular with two extensions 154, 156. The second end wall 150 includes a number of second coupling components 158. In an exemplary embodiment, the second end wall second coupling components 158 include associated sets of passages 160 and pressure release rivets 162, associated sets of passages 164 and fasteners 166, and associated sets of passages 168 and releasable fasteners 170.

The associated sets of passages 160 and pressure release rivets 162 include passages that are sized to correspond to the associated pressure release rivets 162. The pressure release rivets 162 are sized to snuggly correspond to the sidewall second edge first coupling components 128 which, in an exemplary embodiment, are passages 129. The pressure release rivets 162 are structured to decouple from the sidewall second edge first coupling components 128 when exposed to a selected, first pressure or bias.

The associated sets of passages 164 and fasteners 166 are, in an exemplary embodiment, passages 164 and corresponding nut-and-bolt fasteners 167. The sets of passages 168 and releasable fasteners 170 are located on the extensions 154, 156. The releasable fasteners 170, as shown nylon bolts 180 and nylon nuts 182, are structured to decouple from the sidewall second edge first coupling components 128 when exposed to a selected, second pressure or bias. The selected second pressure or bias is higher/greater than the first pressure or bias.

The third end wall 190, in an exemplary embodiment, is a back cover 191. That is, the third end wall 190 is a generally planar body. It is understood that the third end wall 190 includes a number of passages (not shown) structured to allow elements of the electrical apparatus 10, such as but not limited to bus members, to pass therethrough. In another exemplary embodiment, the front surface of the heat sink 60 defines the third end wall 190. That is, the surface of the heat sink 60 facing the baffle assembly 110 is the third end wall 190. In this embodiment, the heat sink 60 includes a number of coupling components, such as, but not limited to threaded bores.

The sidewalls 120, first end wall 140, second end wall 150, and third end wall 190 are made from non-conductive materials. In an exemplary embodiment, the sidewalls 120, first end wall 140, and third end wall 190 are made from a poly-glass insulation material. The transparent second end wall 150 is, in an exemplary embodiment, made from a clear material, such as, but not limited to a laminated fiberglass reinforced polyester, and may be identified as GPO-3. It is further understood that the various coupling components discussed above and below are structured, i.e. positioned and sized, to align with each other when in the assembled configuration.

The baffle assembly 110 is assembled as follows. A sidewall tab 124 is disposed adjacent to, or abutting, the heat sink 60 with the longitudinal edge first coupling components 128 aligned with the threaded bores in the heat sink 60. A coupling component (not shown), such as, but not limited to bolts, are passed through the longitudinal edge first coupling components 128 and into the threaded bores in the heat sink 60.

The first end wall 140 is sealingly coupled to each sidewall first edge surface 130. As used herein, "sealingly coupled" means structured to resist, but not necessarily prevent, a gas passing therethrough. Thus, two abutting generally planar surfaces are "sealingly coupled" as used herein. In an exemplary embodiment, the generally planar first end wall 140 abuts generally planar first edge surfaces 130 of the sidewalls 120. In an alternative embodiment, not shown, the generally planar first end wall 140 includes a number of grooves that correspond to the location and size of each sidewall first edge surface 130. In another embodiment, a number of sidewalls 120 include a mounting member 123, such as, but not limited to, an angle member 125, that is coupled to a sidewall 120 and first end wall 140. The mounting member 123 also acts to sealingly couple the sidewall 120 to first end wall 140.

The second end wall 150 is sealing coupled to each sidewall second edge surface 132, and in an exemplary embodiment, to each tab 124. Further, the second end wall 150 is sealing coupled to first end wall 140. In an exemplary embodiment, fasteners 166, i.e. nut-and-bolt fasteners 167 couple the lower portion of second end wall 150 to mounting tab 144. This coupling is not separable when exposed to the pressure or bias created by arc gas. The medial portion of second end wall 150 is sealing coupled to each sidewall second edge surface 132 by pressure release rivets 162. That is, the pressure release rivets 162 extend into, and are snuggly disposed in, passages 129. Further, on the extensions 154, 156, the second end wall 150 is sealingly coupled to each sidewall second edge surface 132 by releasable fasteners 170.

In this configuration, the second end wall 150 is separably and sealingly coupled to each sidewall second edge 132. That is, the second end wall 150 is structured to move between a first configuration, wherein the second end wall 150 is sealingly coupled to substantially the entire length of each sidewall second edge 132, and a second configuration, wherein second end wall 150 is sealingly coupled to first end wall 140. Further, because the releasable fasteners 170 are structured to release at a higher pressure/bias than the pressure release rivets 162, the second end wall 150 will only begin to move to the second configuration when the releasable fasteners 170 are exposed to the second pressure. Then, however, the pressure release rivets 162 will release quickly as they are exposed to a pressure higher than the first pressure.

Thus, in operation, the baffle assembly 110 is temporarily coupled to the electrical components 12 with each aligned set of terminals 70A, 70B, 70C disposed in a channel 122. When an arc test is performed, i.e. by placing a wire across terminals 54A, 54B of different phases, an arc is generated along with arc gas. The arc gas, however, is substantially confined to the channels 122 that are part of the test. Thus, the configuration disclosed herein solves the problem of migrating arc gas. Further, if the pressure created by the arc gas is sufficiently high, the second end wall 150 moves to the second configuration, thereby releasing the arc gas to the atmosphere.

The coating 48, in an exemplary embodiment, is a Polyvinyl chloride (PVC). The coating 48 is applied to substantially all of the first conductor 42 and to a portion of the fuse element 44. In another embodiment, the coating 48 is applied to the second conductor 46 as well. The coating 48 protects the conductor 42 and a portion of the fuse element 44 from the arc gas. The coating 48 allows for viewing of the fuse indicator (not shown). Further, the coating 48 does not substantially thermally insulate fuse element 44. Further, in an exemplary embodiment, a sleeve (not shown) is applied to transformer coupling 20, including transformer secondary cables, overlapping the coated copper conductor extending the isolation barrier between secondary phases to the face of the transformer 16.

In this embodiment, the ability of arc gasses to bypass the fuse body and connected copper on the primary of the fuse is substantially reduced.

In an exemplary embodiment, the coating 48 is applied by dipping the fuse assembly 40 in PVC in a liquid state. The duration of dip, i.e. the time during which the fuse assembly 40 is in the in liquid PVC, determines the thickness of the resulting coating 48. In an exemplary embodiment, the thickness of the coating 48 is about 0.08 inch. In an exemplary embodiment, the liquid coating 48 creates a thickness of about 0.06 inch for every five seconds of dipping time. Thus, in an exemplary embodiment, the fuse assembly 40 is dipped for about seven seconds.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A baffle assembly for an electrical apparatus, said electrical apparatus including a number of electrical components and a conductor assembly, said electrical components including a number of terminals, said electrical component terminals disposed in a plurality of aligned sets, said conductor assembly including a number of conductors, said conductors extending laterally over a number of aligned sets, said baffle assembly comprising:

a number of generally planar sidewalls, each said sidewall including a first edge surface, a second edge surface, and a third edge surface;

said sidewalls disposed in a spaced, generally parallel configuration defining a number of channels;

said sidewall first edges and said sidewall second edges extending in generally different directions;

a first end wall, said first end wall sealingly coupled to each said sidewall first edge;

a second end wall, said second end wall sealingly coupled to each said sidewall second edge; and a third end wall, said third end wall sealingly coupled to each said sidewall third edge.

2. The baffle assembly of claim 1 wherein:

said first end wall is sealingly coupled to said second end wall; and said first end wall is sealingly coupled to said third end wall.

3. The baffle assembly of claim 2 wherein:

each said sidewall first edge is generally straight;

each said sidewall second edge is generally straight;

each said sidewall third edge is generally straight;

said first end wall sealingly coupled to each said sidewall first edge;

said second end wall is generally planar; and said third end wall is generally planar.

4. The baffle assembly of claim 3 wherein:

said second end wall is separably and sealingly coupled to each said sidewall second edge surface; and wherein said second end wall is structured to move between a first configuration, wherein said second end wall is sealingly coupled to substantially the entire length of each said sidewall second edge, and a second configuration, wherein said second end wall is sealingly coupled to said first end wall.

5. The baffle assembly of claim 4 wherein:

each said sidewall second edge includes a number of first coupling components;

said second end wall includes a number of second coupling components; and each said second coupling component separably coupled to an associated first coupling component.

6. The baffle assembly of claim 5 wherein:

each said sidewall second edge first coupling component is a passage; and each said second end wall second coupling component includes a pressure release rivet.

7. The baffle assembly of claim 6 wherein:

said each said first edge extends generally normal to the associated second edge;

said first end wall includes a generally planar mounting tab;

said first end wall mounting tab projects in a plane generally normal to the plane of said first end wall;

said first end wall mounting tab including a number of mounting first components;

said second end wall includes a number of mounting second components; and said first end wall mounting tab mounting first components coupled to said second end wall mounting second components.

8. The baffle assembly of claim 7 wherein:

each said sidewall second edge surface includes a tab;

wherein each said sidewall second edge tab is generally planar; and the plane of each said sidewall second edge tab extending generally normal to the plane of each said sidewall.

9. The baffle assembly of claim 1 wherein said second end wall is generally transparent.

10. The electrical apparatus of claim 9 wherein:

said electrical components include a number of fuse assemblies;

each fuse assembly including a first conductor, a fuse element, a second conductor, and a coating; and said coating applied to substantially all of said first conductor and to a portion of said fuse element.

11. The electrical apparatus of claim 10 wherein said coating is applied to substantially all of said second conductor.

12. An electrical apparatus comprising:

a number of electrical components, said electrical components including a number of terminals, said electrical component terminals disposed in a plurality of aligned sets;

a conductor assembly, said conductor assembly including a number of conductors, said conductors extending laterally over a number of aligned sets;

a baffle assembly including a number of generally planar sidewalls, a first end wall, a second end wall, and a third end wall;

each said sidewall including a first edge surface, a second edge surface, and a third edge surface;

said sidewalls disposed in a spaced, generally parallel configuration defining a number of channels;

wherein a portion of each said aligned set is disposed in a channel;

said sidewall first edges and said sidewall second edges extending in generally different directions;

said first end wall sealingly coupled to each said sidewall first edge;

said second end wall sealingly coupled to each said sidewall second edge; and said third end wall sealingly coupled to each said sidewall third edge.

13. The electrical apparatus of claim 10 wherein:

said first end wall is sealingly coupled to said second end wall; and said first end wall is sealingly coupled to said third end wall.

14. The electrical apparatus of claim 13 wherein:

each said sidewall first edge is generally straight;

each said sidewall second edge is generally straight;

each said sidewall third edge is generally straight;

said first end wall sealingly coupled to each said sidewall first edge;

said second end wall is generally planar; and said third end wall is generally planar.

15. The electrical apparatus of claim 14 wherein:

said second end wall is separably and sealingly coupled to each said sidewall second edge surface;

wherein said second end wall is structured to move between a first configuration, wherein said second end wall is sealingly coupled to substantially the entire length of each said sidewall second edge, and a second configuration, wherein said second end wall is sealingly coupled to said first end wall.

16. The electrical apparatus of claim 15 wherein:

each said sidewall second edge includes a number of first coupling components;

said second end wall includes a number of second coupling components; and each said second coupling component separably coupled to an associated first coupling component.

17. The electrical apparatus of claim 16 wherein:

each said sidewall second edge first coupling component is a passage; and each said second end wall second coupling component is a pressure release rivet.

18. The electrical apparatus of claim 17 wherein:

said each said first edge extends generally normal to the associated second edge;

said first end wall includes a generally planar mounting tab;

said first end wall mounting tab extending in a plane generally normal to the plane of said first end wall;

said first end wall mounting tab including a number of mounting first components;

said second end wall includes a number of mounting second components; and said first end wall mounting tab mounting first components coupled to said second end wall mounting second components.

19. The electrical apparatus of claim 18 wherein:

each said sidewall second edge surface includes a tab;

wherein each said sidewall second edge tab is generally planar; and the plane of each said sidewall second edge tab extending generally normal to the plane of each said sidewall.

20. The electrical apparatus of claim 12 wherein said second end wall is generally transparent.

* * * * *